US005725021A

United States Patent [19]

Dallas

[11] Patent Number: 5,725,021

[45] Date of Patent: Mar. 10, 1998

[54] SYSTEM FOR RETRIEVING WASTE DRILLING MUD

[76] Inventor: James Leslie Dallas, 26 Beechfield Road, Elgim, Moray, Scotland, 1V30 3RT

[21] Appl. No.: 568,954

[22] Filed: Dec. 7, 1995

[51] Int. Cl.[6] ..... E21B 21/10

[52] U.S. Cl. ..... 137/563; 175/66; 175/217

[58] Field of Search ..... 137/563; 175/66, 175/217

[56] References Cited

U.S. PATENT DOCUMENTS

| | | | |
|---|---|---|---|
| 2,241,273 | 5/1941 | Robinson et al. | 175/217 X |
| 2,870,990 | 1/1959 | Bergey | 175/217 X |
| 2,923,151 | 2/1960 | Engle et al. | 175/217 X |
| 2,941,783 | 6/1960 | Stinson | 175/66 X |
| 4,506,986 | 3/1985 | Freeman | 137/563 X |
| 4,650,339 | 3/1987 | Chetcuti et al. | 137/563 X |
| 5,093,008 | 3/1992 | Clifford, III | 175/66 X |
| 5,129,469 | 7/1992 | Jackson | 175/66 |
| 5,203,367 | 4/1993 | Akai et al. | 137/563 X |

*Primary Examiner*—John Rivell
*Attorney, Agent, or Firm*—Gunn & Associates, P.C.

[57] ABSTRACT

For use with a mud pit connected to a drilling rig, a first pipe and connected pump pulls mud from the pit for use or disposal. The pit is provided with a bottom located drain line with a valve connected to an added pipe, a serially connected pump and outlet pipe going to a backload line for recovery in a tanker.

10 Claims, 1 Drawing Sheet

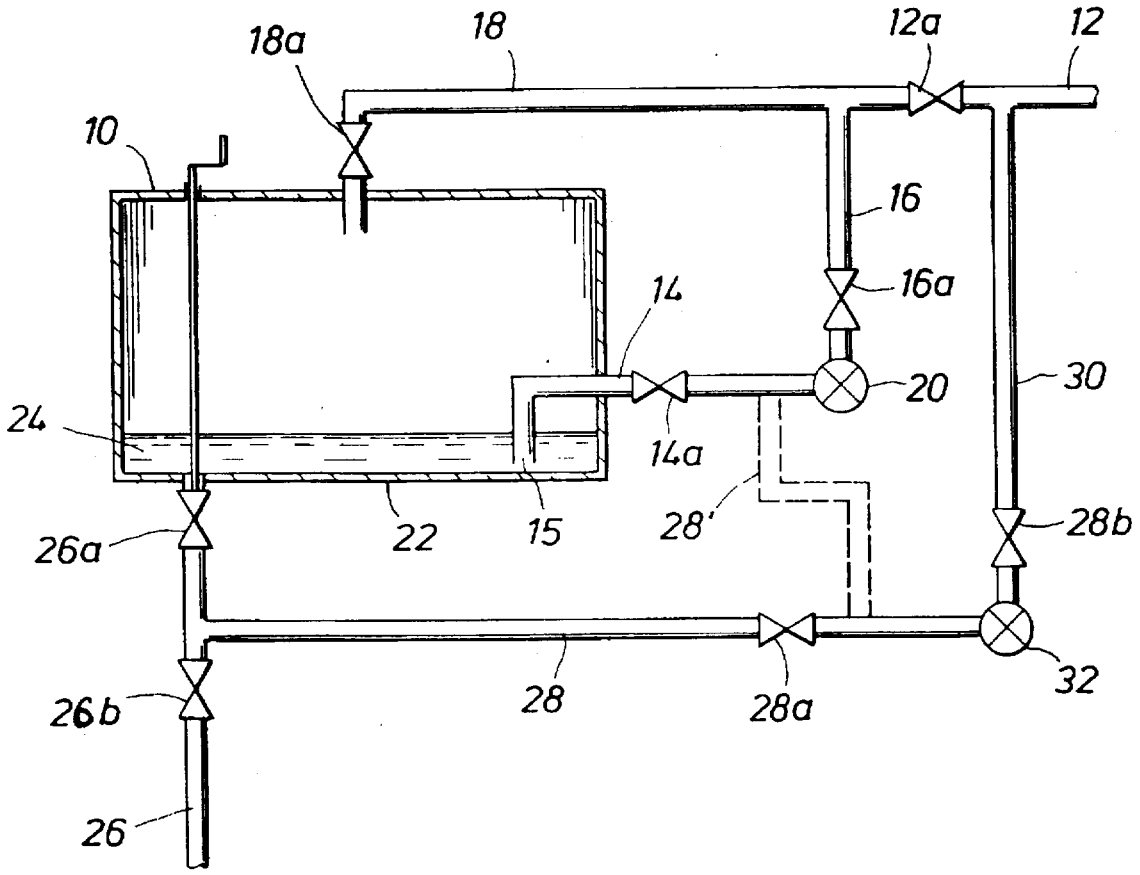
18a
18
12a
12
10
16
16a
14
20
30
24
14a
28'
28b
26a
22
15
32
26b
28
28a
26

SYSTEM FOR RETRIEVING WASTE DRILLING MUD

BACKGROUND OF THE DISCLOSURE

This invention relates to a system for use in the retrieval of waste drilling mud. Drilling mud is used in the drilling of deep wells, such as may be required in oil and gas extraction operations. The drilling mud may service a number of functions including lubricating and cooling the drilling bit, and carrying debris from the bore. By controlling the pressure of the drilling mud it is also possible to control specially adapted tools provided on a drill string.

To properly service all of these functions, the drilling mud is typically a carefully controlled composition which after a certain degree of usage will require replacement or reprocessing. In offshore operation the mud is normally brought to the platform or rig by a tanker which, in addition to providing a fresh supply of drilling mud, will take away the "waste" mud for reprocessing or disposal. The mud is stored on the platforms in mud "pits". Added mud is pumped from the supply tankers to the mud pit through backload lines. The backload line forms part of a pipe network including various valves and a pump which may be used to extract mud from the pit, and which is also used to provide a mixing action when fresh materials have been added to the mud. The pump is also used to supply mud from the pit to the drill string.

When the pit is to be drained, the valves in the network are configured such that the pump may be used to draw mud from the pit and pump it through the backload line into a mud tanker. However, the design of existing mud pits is such that a residue tends to collect on the floor of the pit and which is not drawn away by the pump. This residue may amount to several hundred barrels of mud for a typical battery of mud pits on the platform. Accordingly, after the pump has drawn as much mud as it can from the pit, a dump valve located in a lower portion of the mud pit is opened, allowing the residue to flow through a dump line onto the seabed. As the lost residue is material which may have been reprocessed, this loss of material involves considerable expense for the platform operator. Also, the various additives to the mud may result in unacceptable pollution levels around the platform. It is an object of the present invention to obviate or mitigate these disadvantages.

According to the present invention, there is provided a system for retrieving waste drilling mud from a mud pit having a backload line for use in filling the pit and a dump line extending from a lower portion of the pit for use in draining the pit, the system comprising: a valve on the dump line; a pipe connecting the dump line above said valve to the backload line; and pump means for pumping mud from the dump line to the backload line.

Use of the system allows substantially all of the drilling mud to be retrieved from the mud pit for reprocessing for re-use, or for safe disposal. The system may be provided on an existing mud pit, without requiring extensive modifications to be made thereto.

The pump means may be a dedicated pump provided on the pipe connecting the dump and backload lines, or may be an existing pump to be used in conjunction with an appropriate valve arrangement. This and other aspects of the present invention will now be described, by way of example with reference to the accompanying drawing which is a schematic view of a system for retrieving waste drilling mud from a mud pit, in accordance with a preferred embodiment of the present invention.

DETAILED DESCRIPTION OF THE PREFERRED EMBODIMENT

The drawing shows a mud pit 10 such as used with offshore oil and gas drilling or production platforms. The pit

10 is normally filled with drilling mud, and a plurality of similar mud pits will be provided on a platform. Mud is supplied to the platform by a tanker from which the mud is pumped, through a backload line 12, into the mud pit. Once a load of mud has been delivered to the pit 10, various additives or compounds are added to the mud such that it is suitable for its intended end use. Mixing of the mud and the added ingredients is achieved by circulating mud in a loop defined by pipe sections 14, 16, and 18 by means of a first pump 20. The inlet 15 of the pipe section 14 is located adjacent the pit floor 22. During the mixing operation, valves **14*a*, 16*a*, 18*a* installed in the respective pipe sections are opened to allow circulation of the mud, while a valve 12*a* isolates the circulating mud from the backload line 12**. After mixing, the mud is supplied to the drill string via a separate pumping system not shown in the drawings. Such cooperative apparatus is believed to be well known.

The "used" mud is returned to the pit 10, or to another similar pit, through the backload line 12 and the pipe section 18. After the mud has been used a number of times, the used mud is drawn from the pit 10, pressured through the first pump 20, and passes through the backload line 12 to a mud tanker, to be taken away for reprocessing or disposal. In existing mud pits, the open end of the pipe section 14 is positioned above the pit floor 22, such that a residue of mud 24 will remain in the pit 10, as shown in the drawing. In existing arrangements, this residue 24 is drained from the pit 10 through a dump line 26, which leads to the seabed, by opening a dump valve **26*a*. However, in the system according to the present invention a further valve 26*b* is provided in the dump line 26 and additional pipe sections 28 and 30 which connect from the dump line 26 to the backload line 12 via a second dedicated pump 32. Thus, by opening the valve 26*a* while keeping the valve 26*b* closed, the residue 24 may be drained from the pit 10 and pumped via the dedicated pump 32 through the pipe sections 28 and 30 to the backload line 12** and into the mud tanker.

Thus, from the above description, it may be seen that the present invention allows the mud pit 10 to be completely drained of drilling mud such that the entire volume of mud is available for reprocessing and re-use.

It will be obvious to those of skill in the art that the above described embodiment is merely exemplary of the present invention and that various modifications and improvements may be made to the illustrated embodiment without departing from the scope of the invention, for example, rather than providing the second pump 32, the pipe section 28 may lead as illustrated by a broken line extension 28', to the first pump 20 such that, by appropriate configuration of the valves **28*a*, 28*b*, 14*a*, 16*a*, and 12*a*, the pump 20 may be used to drain the pit through the dump line 26 and the pipe section 28**.

What is claimed is:

1. A system for retrieving waste drilling mud from a mud pit having a backload line for use in filling the pit and a dump line extending from a lower portion of the pit for use in draining the pit, the system comprising:

(a) a first valve on the dump line;

(b) a first pipe connecting to the dump line above said first valve to the backload line; and (c) pump means for pumping mud from the dump line to the backload line.

2. The system of claim 1 wherein the pump means is a dedicated pump serially connected in the pipe connecting the dump and backload lines.

3. The system of claim 1 wherein the pump means is a first pump hydraulically connected to the dump line and the backload line with an appropriate valve arrangement.

4. The system of claim 1 wherein said pit has a bottom located drain into said dump line.

5. The system of claim 1 wherein said dump line is bottom connected to said pit and opens into said first pipe through said first valve, and said pump means can be hydraulically isolated from said dump line and said backload line by closing valves.

6. The system of claim 5 wherein said pump means connects to said backload line, and said backload line connects to fill said pit, or alternately, drain said pit.

7. The system of claim 6 wherein said dump line serially connects said first valve and a second valve operable to drain said pit.

8. The system of claim 7 wherein said pump means connects to a pipe section which is connected said backload line, and flow in said pipe section is in a direction which drains said pit, while flow in said backload line is in either of two directions there through.

9. The system of claim 8 wherein said backload line has:

(a) flow in a first direction to fill the pit; and (b) flow in a second direction opposite to the first direction to drain the pit.

10. The system of claim 9 wherein said pit has a mud recirculation path returning recirculated mud into the pit through said backload line.

* * * * *